US006416879B1

(12) United States Patent
Sakamoto et al.

(10) Patent No.: US 6,416,879 B1
(45) Date of Patent: Jul. 9, 2002

(54) FE-BASED AMORPHOUS ALLOY THIN STRIP AND CORE PRODUCED USING THE SAME

(75) Inventors: Hiroaki Sakamoto; Yuichi Sato, both of Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/957,899

(22) Filed: Sep. 21, 2001

(30) Foreign Application Priority Data

| | | |
|---|---|---|
| Nov. 27, 2000 | (JP) | 2000-360195 |
| Mar. 22, 2001 | (JP) | 2001-083309 |
| Apr. 20, 2001 | (JP) | 2001-123359 |

(51) Int. Cl.[7] ..... H01F 1/153

(52) U.S. Cl. ..... 428/606; 428/611; 428/577; 428/900; 428/928; 428/638; 148/100; 148/121; 148/304; 148/306; 148/307; 148/403; 336/229; 336/232; 336/234; 29/605; 29/609

(58) Field of Search ..... 428/606, 611, 428/577, 592, 637, 638, 682, 683, 900, 928; 148/100, 121, 304, 306, 307, 403; 336/229, 232, 234; 29/605, 609

(56) References Cited

U.S. PATENT DOCUMENTS 5,958,153 A * 9/1999 Sakamoto et al.

FOREIGN PATENT DOCUMENTS

| | | |
|---|---|---|
| JP | 57-185957 | 11/1982 |
| JP | 60-255934 | 12/1985 |
| JP | 62-93339 | 4/1987 |
| JP | 62-294154 | 12/1987 |
| JP | 63-45318 | 2/1988 |
| JP | 5-140703 | 6/1993 |
| JP | 6-220592 | 8/1994 |
| JP | 6-264197 | 9/1994 |
| JP | 7-331396 | 12/1995 |
| JP | 8-144029 | 6/1996 |
| JP | 8-193252 | 7/1996 |
| JP | 9-202951 | 8/1997 |
| JP | 9-268354 | 10/1997 |
| JP | 11-293427 | 10/1999 |

OTHER PUBLICATIONS

Fujii et al., "Magnetic properties of fine crystalline Fe–P–C–Cu–X alloys," J. Appl. Phys. 70(10) pp. 6241–6243, Nov. 15, 1991.*

* cited by examiner

*Primary Examiner*—Deborah Jones
*Assistant Examiner*—Tamra L. Dicus
(74) *Attorney, Agent, or Firm*—Kenyon & Kenyon

(57) ABSTRACT

The object of the present invention is to provide an Fe-based amorphous alloy thin strip capable of realizing an excellent soft magnetic property for use in alternating current applications while keeping a high magnetic flux density even in a composition range with a high Fe content, and an Fe-based amorphous alloy thin strip with which a core having an excellent soft magnetic property can be manufactured, even if there occurs a temperature difference among different portions of the core during annealing. The present invention is an Fe-based amorphous alloy thin strip having a high magnetic flux density, consisting of the main component elements of Fe, Si, B, C, and P and unavoidable impurities, characterized by having: a composition, in atomic %, of $82<Fe\leqq 90$, $2\leqq Si<4$, $5<B\leqq 16$, $0.02\leqq C\leqq 4$, and $0.2\leqq P\leqq 12$; $B_s$ of 1.74 T or more after annealing; $B_{80}$ exceeding 1.5 T; and a low core loss of 0.12 W/kg or less.

19 Claims, No Drawings

FE-BASED AMORPHOUS ALLOY THIN STRIP AND CORE PRODUCED USING THE SAME

BACKGROUND OF THE INVENTION

1. Field of the Invention

The present invention relates to an amorphous. alloy thin strip used for wound cores of power transformers, high frequency transformers and the like.

2. Description of the Related Art

The methods to continuously produce thin metal strips and wires by rapidly cooling an alloy in a molten state include methods such as the centrifugal rapid cooling method, the single roll method, the twin roll method and the like. These methods rapidly solidify molten metal to produce thin metal strips and wires by ejecting it through an orifice or the like onto the inner or outer surface of a metal drum rotating at high speed. Further, it is possible to produce amorphous alloys similar to liquid metal and obtain materials excellent in magnetic or mechanical properties by properly selecting the composition of the alloys.

The amorphous alloys are considered promising as industrial materials for widely varied uses owing to their excellent properties. Among the amorphous alloys, an Fe-based amorphous alloy thin strip, for example an Fe-Si-B amorphous alloy thin strip, is used for the cores of power transformers, high frequency transformers and the like by virtue of its low core loss, high saturation magnetic flux density, high magnetic permeability and other advantages.

However, although an Fe-Si-B amorphous alloy thin strip has a better core loss compared with a silicon steel sheet, its saturation magnetic flux density $B_s$ is inferior. This is because, when the content of Fe is increased for enhancing the saturation magnetic flux density, the ability of the alloy to form an amorphous state is deteriorated and stable production of the amorphous alloy thin strip becomes difficult. If it is possible to increase the saturation magnetic flux density while maintaining the amorphous state forming ability, downsizing of cores becomes viable and the degree of freedom in the design of cores for transformers and the like is increased, which will bring about great advantages. In response to the above needs, the following technologies have been proposed.

Japanese Unexamined Patent Publication No. H5-40703, for instance, discloses an amorphous alloy thin strip having a composition, in atomic %, of $(Fe_aSi_bB_cC_d)_{100-x}Sn_X$, where: a=0.80 to 0.86, b=0.01 to 0.12, c=0.06 to 0.16, d=0.001 to 0.04, a+b+c+d=1, and X=0.05 to 1.0. This technology makes it possible to improve the amorphous state forming ability even in a high Fe range by an addition of Sn, but the saturation magnetic flux density actually obtained is 1.73 T at most.

Japanese Unexamined Patent Publication No. H6-220592, as another example, discloses an amorphous alloy thin strip having a composition, in atomic %, of $Fe_aCo_bSi_cB_dM_X$, where: $60 \leqq a \leqq 83$, $3 \leqq b \leqq 20$, $80 \leqq a+b \leqq 86$, $1 \leqq c \leqq 10$, $11 \leqq d \leqq 16$, $0.1 \leqq X \leqq 1.0$ when M is Sn, $0.1 \leqq X \leqq 2.0$ when M is Cu or $0.01 \leqq X \leqq 0.07$ when M is S, and a+b+c+d+X=100. A large saturation magnetic flux density is obtained by this technology thanks to the Co addition of Co. However, Co is a very expensive element and, although Fe-based amorphous alloy thin strips containing Co are used for some high-grade uses, the technology has the shortcoming of high material cost.

Besides these, Japanese unexamined Patent Publication No. H6-264197 discloses an amorphous alloy thin strip having a composition, in atomic %, of $Fe_XB_YSi_ZMn_a$, where: $80<X \leqq 83$, Y=6 to 11, Z=8 to 13, a=0.5 to 3. In this technology, the insulation film treatment property of the material is enhanced by an addition of Mn, but the alloy cannot attain the magnetic flux density of 1.7 T.

Thus, it has been impossible to produce a practically applicable and low-cost Fe-based amorphous alloy thin strip having a high saturation magnetic flux density by any conventional technology.

As described above, it has been difficult to stably obtain an amorphous alloy thin strip in an as cast or as annealed condition, because, when the content of Fe of an Fe-based amorphous alloy thin strip is increased aiming at enhancing the saturation magnetic flux density, the amorphous state forming ability of the alloy is deteriorated and crystallization proceeds locally.

When fabricating a wound core or a laminated core transformer using an amorphous alloy thin strip, it is a normal practice to form a core by laminating a multiplicity of thin strips and to anneal the core under a direct current magnetic field applied in the direction of its magnetic circuit. The annealing is done to lower strain in the strips and create magnetic anisotropy in the direction of the applied magnetic field. However, when the annealing temperature is too low, it becomes difficult to lower the strain and create the magnetic anisotropy.

When the annealing temperature is too high, in contrast, the thin strips crystallize and the excellent soft magnetic property intrinsic to the amorphous material disappears. For this reason, there is an optimum temperature in the annealing of a core.

The heavier the core and the larger its volume, the more a temperature unevenness is apt to be generated at different portions of the core during heating after it is charged into a heat treatment furnace. When a sufficient time is secured for the heating and cooling processes, the temperature unevenness is minimized, but this lowers productivity.

Various methods have been proposed to improve the annealing process such as: a method to minimize the temperature difference in a core during cooling by attaching heat insulating materials to the inner and outer surfaces of the core (Japanese Unexamined Patent Publication No. S63-45318); a method to immerse a core in a bath of an ultra-heat-resistant insulating oil kept at an annealing temperature (Japanese Unexamined Patent Publication No. S60-255934); a method to immerse a core in a molten tin bath kept at an appropriate temperature not exceeding the glass-transition temperature and then in a cooling liquid bath (Japanese Unexamined Patent Publication No. S62-294154); etc.

These methods improve the annealing process. However, these method did not improve the thin strips quality nor their magnetic properties even when there occurs a temperature unevenness among different portions of a core.

As a technology to improve the thin strip proper, on the other hand, Japanese Unexamined Patent Publication No. S57-185957 proposes a method to add 1 to 10 atomic % of P, as a substitute of expensive B, to an amorphous alloy thin strip containing, in atomic %, 1 to 5% of B and 4 to 14% of Si. P in this patent publication is meant as an element to enhance the amorphous state forming ability as do B, Si and C.

Further, Japanese Unexamined Patent Publication No. H8-193252 discloses, for the purpose of reducing the use of expensive B, an alloy having a composition, in atomic %, of 6 to.10% of B, 10 to 17% of Si, 0.02 to 5% of P and the balance consisting of Fe. P in the composition of this patent publication is meant to improve the surface roughness of the strip.

As another example, Japanese Unexamined Patent Publication No. H9-202951 discloses an alloy, having a composition, in atomic %, of 76 to 80% of Fe, 6 to 10% of B, 8 to 17% of Si, 0.02 to 2% of P and 0.2 to 1.0% of Mn, aimed at improving the magnetic properties and workability in a condition of a high Si content and a B content of 10 atomic % or less. The effect of P in the alloy composition of this patent publication is limited only to the improvement of the amorphous state forming ability and the addition of Mn is indispensable for suppressing the crystallization caused by the multi-element composition.

Japanese Unexamined Patent Publication No. H9-268354, aiming at improving the magnetic properties even in a low B content range of 10 atomic % or less through an appropriate control of the surface roughness of a strip, discloses an alloy having a composition, in atomic %, of 6 to 10% of B, 10 to 17% of Si as a preferable content range, 0.1 to. 2% of C, 0.2 to 1.0% of Mn, and 0.02 to 2% of P. In the alloy composition of this patent publication, the effect of P is limited to improving the amorphous state forming ability and the surface roughness.

As yet another example, Japanese Unexamined Patent Publication No. H11-293427 discloses an alloy having a composition, in atomic %, of 75.0 to 77.0% of Fe, 2.5 to 3.5% of C, 0.5 to 6.5% of B, 0 to 12.0% of P for said percentage of B, and the balance consisting of Si, for the purpose of effectively suppressing the deterioration of a soft magnetic property as a result of the low content of B. In this alloy composition, too, the effect of P is limited to improving the amorphous state forming ability.

As described above, the technologies to improve the thin strips according to any of the patent publications envisage improving the amorphous state forming ability and/or the surface roughness by the addition of P.

Thus, no method has been introduced to minimize the deterioration of core performance caused by temperature unevenness at different portions of a core during a heating process, when annealing a wound core formed by toroidally winding Fe-based amorphous alloy thin strips or a laminated core formed by laminating alloy thin strips.

However, Japanese Unexamined Patent Publication No. S62-93339 discloses a technology to improve the embrittlement of a material while keeping the core loss at a low level. The patent publication specifies an alloy having a composition, in atomic percentage, of $Fe_XB_YSi_{(100-X-Y)}$, where: $76 \leqq X \leqq 81$, $97 \leqq 2X-5Y \leqq 112$. Here, the alloy composition is defined as one close to the ternary eutectic line of the Fe-Si-B ternary system. The above patent publication maintains that a thin strip low in core loss and free from embrittlement can be obtained, since the specification of the alloy composition makes it possible to complete the annealing before the embrittlement begins to occur even when annealing at a prescribed temperature.

Japanese Unexamined Patent Publication No. S62-93339, however, does not include any description related to quantitative evaluation of brittleness. With respect to the magnetic flux density, although the patent publication describes, in the Examples, values of the magnetic flux density $B_{10}$ under a magnetic field of 1,000 A/m, a high magnetic flux density close to the saturation magnetic flux density can be obtained when a magnetic field of 1,000. A/m is applied to an Fe-Si-B amorphous thin strip even if the annealing is insufficient. When the annealing is insufficient, however, the rise of the magnetic hysteresis loop becomes small, $B_{80}$ (the magnetic flux density under a magnetic field of 80 A/m) becomes low and, consequently, the power for excitation increases.

Besides the above, Japanese Unexamined Patent. Publication No. H7-331396 discloses a thin strip having an improved core loss property without embrittlement of the material and a method to produce the same. The patent publication discloses an amorphous thin strip excellent in magnetic properties and embrittlement resistance having an average roughness Ra at the center line of 0.6 $\mu$m or less and a composition, in atomic percentage, of $Fe_xB_ySi_zMn_a$, where: $75 \leqq x \leqq 82$, $7 \leqq y \leqq 15$, $7 \leqq z \leqq 17$, and $0.2 \leqq a \leqq 0.5$.

However, although Mn is effective for improving core loss, an increase in its content lowers the magnetic flux density and embrittles the material. In consideration of this, the technology of the patent publication realizes the enhancement of the magnetic flux density by reducing diamagnetic field and the prevention of embrittlement by reducing crack initiation points, as a result of decreasing surface unevenness of the strip by rapidly solidifying the alloy of the above composition in a $CO_2$ atmosphere containing 1 to 4% of $H_2$.

The improvement of embrittlement disclosed in the Japanese Unexamined Patent Publication No. H7-331396, however, relates to a thin strip immediately after rapid solidification and not the improvement of embrittlement after annealing to improve the soft magnetic property.

Further, Japanese Unexamined Patent Publication No. H8-144029 discloses a thin strip and a method to produce the same, wherein surface roughness Ra of the thin strip is specified as 0.8 $\mu$m or less for the same purpose as the thin strip and the method to produce it according to the Japanese Unexamined Patent Publication No. H7-331396.

In the thin strip and the method to produce the same of the Japanese Unexamined Patent Publication No. H8-144029, however, the improvement of embrittlement relates to a thin strip immediately after rapid solidification and not to the improvement of embrittlement after annealing to improve the soft magnetic property.

As explained hereinbefore, an Fe-based amorphous alloy thin strip having an excellent embrittlement resistance after annealing in a magnetic field to obtain excellent soft magnetic properties such as magnetic flux density, core loss and the like has not been provided conventionally.

SUMMARY OF THE INVENTION

Among various magnetic property aspects, the inventors of the present invention focused their attention, in the first place, on obtaining a high saturation magnetic flux density, and examined various alloy compositions of Fe-based amorphous alloy thin strips to find one to readily form an amorphous state immediately after rapid cooling even in a high Fe content range. The inventors established the present invention as a result of identifying, from among the examined compositions, a composition range in which the amorphous state is stably maintained even after annealing to sufficiently relieve strain in the thin strip. The present invention has been accomplished by adding a specified amount of P to an alloy comprising specified amounts of Fe, Si, B and C.

The present inventors discovered that, when the composition of an Fe-based amorphous alloy thin strip was defined within a specific range, excellent magnetic properties could be obtained even after the strip was annealed in a wide temperature range. The present invention, which has been established on the basis of the above finding, is an Fe-based amorphous alloy thin strip capable of exhibiting excellent magnetic properties even when a temperature difference occurs among different portions of a core during annealing, and has been accomplished by adding a specific amount of P to an alloy containing specific amounts of Fe, Si, B and C. Note that, while the P addition has been known to be effective for improving the amorphous state forming ability and/or the surface roughness as described in the Description of the Related Art, its "effect to expand the optimum annealing temperature range", which the present inventors discovered, has not been mentioned in any of the Japanese Unexamined Patent Publications Nos. S57-185957, H8-193252, H9-202951, H9-268354 and H10-293427 cited in the Description of the Related Art.

The present invention makes it possible, by adding a prescribed amount of P to an Fe-based amorphous alloy thin strip containing specified amounts of Fe, Si, B and C, to produce an Fe-based amorphous alloy thin strip excellent in soft magnetic property in alternating current in a wide annealing temperature range ΔT of at least 80° C., where the highest annealing temperature of the thin strip is Tmax, the lowest temperature of the same is Tmin and ΔT=Tmax−Tmin.

Here, Tmax is the highest annealing temperature of an Fe-based amorphous alloy thin strip to maintain a maximum magnetic flux density $B_{80}$ of 1.35 T or more under a maximum magnetic field of 80 A/m in alternating current of 50 Hz, without causing the thin strip to crystallize. In other words, when the Fe-based amorphous alloy thin strip is annealed at a temperature exceeding Tmax, the thin strip crystallizes, its magnetic properties are deteriorated and the maximum magnetic flux density $B_{80}$ falls to below 1.35 T.

Tmin is the lowest annealing temperature of the Fe-based amorphous alloy thin strip to reduce the strain of the thin strip, create magnetic anisotropy in the direction of the applied magnetic field during annealing and keep the value of $B_{80}$ after the annealing at 1.35 T. or more.

The present invention makes it possible, by adding a prescribed amount of P to an Fe-based amorphous alloy thin strip containing specified amounts of Fe, Si, B and C, to produce an Fe-based amorphous alloy thin strip having both an excellent soft magnetic property for use in alternating current applications, with $B_{80}$ of 1.35 T or more and an excellent embrittlement resistance with a bend fracture strain $\epsilon_f$ of 0.01≦or more after annealing.

Here, $\epsilon_f=t/(D_f-t)$, where: t is the strip thickness and $D_f$ is the bend diameter at strip failure.

The gist of the present invention having the above characteristics is as follows:

(1) An Fe-based amorphous alloy thin strip consisting of the main component elements of Fe, Si, B, C and P and unavoidable impurities, characterized in that its composition is, in atomic %, 78≦Fe≦90, 2≦Si<4, 5≦B≦16, 0.02≦C≦4, and 0.2≦P≦12.

(2) An Fe-based amorphous alloy thin strip according to (1) excellent in soft magnetic property for use in alternating current applications, characterized in that its composition is, in atomic %, 78≦Fe≦86, 2≦Si<4, 5<B≦16, 0.02≦C≦4, and 0.2≦P≦12.

(3) An Fe-based amorphous alloy thin strip excellent in soft magnetic property for use in alternating current applications according to (2), characterized in that the Fe content is 80≦Fe 6 82 atomic %.

(4) An Fe-based amorphous alloy thin strip excellent in soft magnetic property for use in alternating current applications according to (2) or (3), characterized in that the P content is 1≦P≦12 atomic %.

(5) An Fe-based amorphous alloy thin strip excellent in soft magnetic property for use in alternating current applications according to any one of (2) to (4), characterized in that the B content is 5<B<14 atomic (6) An Fe-based amorphous alloy thin strip excellent in soft magnetic property for use in alternating current applications according to any one of (2) to (5), characterized by having, after annealing, a soft magnetic property with the value of $B_{80}$ of 1.35 T or more and the standard deviation of $B_{80}$ of less than 0.1.

(7) An Fe-based amorphous alloy thin strip excellent in soft magnetic property for use in alternating current applications according to (6), characterized by further having, after annealing, a core loss property with a core loss value of 0.12 W/kg or less.

(8) An Fe-based amorphous alloy thin strip excellent in soft magnetic property for use in alternating current applications according to any one of (2) to (7), characterized by having an annealing temperature property with a ΔT of at least 80° C., where the highest temperature of the thin strip annealing to secure the soft magnetic property with $B_{80}$ of 1.35 T or more and a standard deviation of $B_{80}$ below 0.1 is Tmax, the lowest temperature of the same annealing is Tmin and ΔT=Tmax−Tmin.

(9) An Fe-based amorphous alloy thin strip excellent in a soft magnetic property for use in alternating current applications according to (8), characterized by having, in addition to the soft magnetic property, an annealing temperature property with a ΔT of at least 60° C., where the highest temperature of the thin strip annealing to secure the core loss property with a core loss value of 0.12 W/kg or less is Tmax, the lowest temperature of the same annealing is Tmin and ΔT=Tmax−Tmin.

(10) An Fe-based amorphous alloy thin strip excellent in soft magnetic property for use in alternating current applications according to any one of (2) to (5), characterized by having, after annealing, both an excellent soft magnetic property with $B_{80}$ of 1.35 T or more and an excellent embrittlement resistance with bend fracture strained $\epsilon_f$ of 0.01 or more (where $\epsilon_f=t/(D_f-t)$, t is the strip thickness and $D_f$ is the bend diameter at strip failure).

(11) An Fe-based amorphous alloy thin strip excellent in soft magnetic property for use in alternating current applications according to (10), characterized by having, after annealing, a core loss property with a core loss value of 0.12 W/kg or less.

(12) An Fe-based amorphous alloy thin strip according to (1) having a high magnetic flux density, characterized in that its composition is, in atomic %, 86<Fe≦90, 2≦Si<4, 5<B≦16, 0.02≦C≦4, and 0.2=P≦12.

(13) An Fe-based amorphous alloy thin strip having a high magnetic flux density according to (12), characterized in that the Fe content is 86<Fe≦88 atomic %.

(14) An Fe-based amorphous alloy thin strip having a high magnetic flux density according to (12) or (13), characterized in that $B_s$ of the strip after annealing is 1.74 T or more.

(15) An Fe-based amorphous alloy thin strip having a high magnetic flux density according to any one of (12) to (14), characterized in that $B_{80}$ of the strip after annealing exceeds 1.5 T.

(16) An Fe-based amorphous alloy thin strip having a high magnetic flux density according to (15), characterized in that, further, the core loss value of the strip after annealing is 0.12 W/kg or less.

(17) An Fe-based amorphous alloy thin strip having a high magnetic flux density according to (1), characterized in that; its composition is, in atomic %, $82<Fe\leqq 90$, $2\leqq Si<4$, $5<B\leqq 16$, $0.02\leqq C\leqq 4$, and $0.2\leqq P\leqq 12$, and $B_s$ of the strip after annealing is 1.74 T or more.

(18) A wound core excellent in soft magnetic property for use in alternating current applications characterized by being produced by winding it toroidally and then annealing the Fe-based amorphous alloy thin strip excellent in soft magnetic property for use in alternating current applications according to any one of (1) to (17).

(19) A laminated core excellent in soft magnetic property for use in alternating current applications characterized by being produced by stamping into the sheets of a prescribed shape, laminating and then annealing the Fe-based amorphous alloy thin strip excellent in soft magnetic property in alternating current applications according to any one of (1) to (17).

DESCRIPTION OF THE PREFERRED EMBODIMENTS

The present invention makes it possible, as a result of greatly increasing the permissible content of Fe by adding a specified amount range of P to an alloy containing specified amounts of Fe, Si, B and C, as described hereinbefore, to raise the saturated magnetic flux density $B_s$ and the magnetic flux density $B_{80}$ under a magnetic field of 80 A/m to levels hitherto unattainable. The present invention further makes it possible to achieve a high magnetic flux density and an excellent soft magnetic property at the same time. Here the excellent soft magnetic property means a core loss of 0.12 W/kg or lower at a single sheet measurement under a magnetic flux density of 1.3 T in a frequency of 50 Hz.

An amorphous alloy thin strip with a $B_s$ value of at least 1.74 T or more makes it possible to design and manufacture a transformer having a high magnetic flux density, and it becomes possible for the transformer to reflect the excellent performance of the high-$B_s$ amorphous alloy thin strip. $B_{80}$ can be regarded as an indicator of the ease of magnetization, as is magnetic susceptibility, magnetic permeability and the like. When $B_{80}$ exceeds 1.5 T, the effect of the increased $B_s$ can be reflected to the performance of a transformer. Further, when the core loss at a single sheet measurement under a magnetic flux density of 1.3 .T in a frequency of 50 Hz is 0.12 W/kg or lower, the excellent performance of an amorphous alloy thin strip is obtained.

In designing a transformer, priority is given to either the magnetic flux density or the core loss depending on the case. For this reason, it is not necessary for a transformer material to satisfy both a high magnetic flux density and a low core loss at the same time. But, if both are achieved at the same time, the performance of the amorphous alloy thin strip can be reflected to the performance of the transformer to the fullest extent.

The reasons why the composition of the thin strip is defined under the present invention are described hereafter. The main characteristic of the present invention is that P is added in a low Si content range of $2\leqq Si<4$ atomic %. The reason for limiting the content of each of the elements is given below.

The content of Fe must be within the range over 82 atomic % and 90 atomic % or less, because, when its content is 82 atomic % or less, a sufficiently high magnetic flux density to enable compact core design cannot be obtained and, when it exceeds 90 atomic %, it becomes difficult to form an amorphous state and a good magnetic property cannot be obtained. It is preferable to control the Fe content to over 86 atomic % and 90 atomic % or less, since this makes it possible to stably obtain $B_s$ of 1.74 T or more. It is more preferable to control it to over 86 atomic % and 88 atomic % or less, since this makes it possible to form a more stable amorphous state and, consequently, stably obtain $B_s$ of 1.74 T or more. When the Fe content is controlled to within the above range, $B_{80}$ is stably kept at above 1.5 T.

The content of Fe must be over 78 atomic % or more and 86 atomic % or less. When its content is below 78 atomic %, a sufficient magnetic flux density required of a core cannot be secured and, when it exceeds 86 atomic %, it becomes difficult to form an amorphous state and, as a result, it becomes impossible to obtain a good magnetic property. For the purpose of obtaining $B_{80}$ of 1.35 T or more in a wider annealing temperature range, it is necessary to increase the Fe content to over 80 atomic %. In order to obtain an amorphous material more stably, further, it is enough to control the Fe content to 82 atomic % or less. Thus, in the Fe content range over 80 atomic % and up to 82 atomic %, an amorphous thin strip having an even better performance is obtained.

The content of Si shall be limited to within the range of 2 atomic % or more and below 4 atomic %, because, when its content is below 2 atomic %, it becomes difficult to stably form an amorphous material. When it is 4 atomic % or more, it becomes impossible to obtain the effects of the addition of P to realize an excellent magnetic property in a high Fe content range and to expand the optimum annealing temperature range, which effects form the characteristics of the present invention.

The content of B shall be limited within the range of 5 atomic % to 16 atomic % or less, because, when the B content is 5 atomic % or less, it becomes difficult to stably form an amorphous material but, when it exceeds 16 atomic %, no further increase in the amorphous state forming ability is brought about. In order to more effectively enjoy the effects of the P addition to realize an excellent magnetic property in a high Fe content range and to expand the optimum annealing temperature range, the B content has to be lowered to below 14 atomic %. Thus, in the B content range over 5 and below 14 atomic %, an excellent amorphous thin strip having a more homogeneous magnetic property is obtained.

C is effective for enhancing the castability of a thin strip. When an alloy contains C, the wettability of the molten alloy and a cooling substrate is increased and it becomes possible to form a good thin strip. When the content of C is below 0.02 atomic %, this effect does not appear, but, if the C content exceeds 4 atomic %, no further increase in the effect appears. The C content is, therefore, limited within the range of 0.02 atomic % or more to 4 atomic % or less.

P is the most important element in the present invention. The present inventors have already discovered and disclosed in Japanese Unexamined Patent Publication No. H9-202946 that a P content of 0.008 mass % or more and 0.1 mass % (0.16 atomic %) or less had an effect to increase the permissible content of Mn and S to expand use of the inexpensive materials. The present invention has been established through a series of tests in which the addition amount of P and the content of Fe, Si, B and C were changed in an attempt to produce a thin strip having an excellent soft magnetic property in alternating current while maintaining a high magnetic flux density in a high Fe content range. The content of P must be within the range of 0.2 atomic % or more to 12 atomic % or less. The reason for this is that, when the P content is below 0.2 atomic %, it becomes impossible to obtain an excellent magnetic property while maintaining a high magnetic flux density under any annealing condition and, if the P content exceeds 12 atomic %, no further effects of the P addition are obtained and, what is more, the magnetic flux density is lowered. When the P content is 1 atomic % or more and 12 atomic % or less, the magnetic flux density is made more homogeneous throughout a strip by the effect of P and, more preferably, when the P content is 1 atomic % or more and 10 atomic % or less, the decrease in the magnetic flux density is checked and the effects of the P addition can be enjoyed more effectively. Further, when the bend fracture strain $\epsilon_f$ is 0.01≦or more, a common transformer can be manufactured while paying little attention to the embrittlement of the thin strip. When $\epsilon_f$ is 0.015 or more, it is better still since the transformer manufacturing becomes yet easier.

If elements such as Mn, S, etc. are included, as unavoidable impurities, in the amounts shown in the Japanese Unexamined Patent Publication No. H9-202946, there will be no particular problem.

What is important in relation to the limitations of the composition is that the effects of the P addition in the present invention show only when a specified amount range of P is added to an alloy containing specified amounts of Fe, Si, B and C, especially in the low Si content range of 2≦Si<4 atomic %.

Next, the present invention makes it possible to produce an Fe-based amorphous alloy thin strip excellent in the soft magnetic property in alternating current by annealing in a wide temperature range ΔT of at least 80° C., where the highest temperature of the thin strip annealing is Tmax, the lowest temperature of the same annealing is Tmin and ΔT=Tmax−Tmin, by adding a specified amount of P to the Fe-based amorphous alloy thin strip described above containing specified amounts of Fe, Si, B and C.

Here "excellent soft magnetic property" means that a maximum magnetic flux density $B_{80}$ is "11.35 T or more" under a maximum alternating current magnetic field of 80 A/m in a frequency of 50 Hz, and that a standard deviation of $B_{80}$ is "less than 0.1" in an annealing temperature range ΔT of at least 80° C. From the viewpoint of ΔT as defined above, it also means that the value of core loss is "0.12 W/kg or lower" in a single sheet measurement under a magnetic flux density of 1.3 T at a frequency of 50 Hz in a wide annealing temperature range ΔT of at least 60° C.

When a wound core formed by toroidally winding Fe-based amorphous alloy thin strips or a laminated core formed by stamping the Fe-based amorphous alloy thin strips and piling the stamped sheets, etc. is annealed for the purpose of reducing strain and creating magnetic anisotropy, the temperature of different portions of the core usually becomes uneven during heating. When the value of $B_{80}$ is at least 1.35 T or more, the performance of the amorphous alloy thin strip can be reflected in the performance of the transformer, but, when there is unevenness of the $B_{80}$ values as a result of the unevenness of the annealing temperature, the soft magnetic property of the core will be deteriorated locally and there may be a problem in the performance of the transformer.

When the standard deviation of $B_{80}$ is below 0.1 as in the present invention, the magnetic flux density in an operating core becomes even and it becomes possible not only to fully enjoy the excellent magnetic performance of the Fe-based amorphous alloy thin strip but also to design a transformer easily.

Also, when the core loss is 0.12 W/kg or less in an annealing temperature range ΔT from Tmax to Tmin of at least 60° C., an excellent performance of the Fe-based amorphous alloy thin strip can be obtained. Thanks to the excellent core loss obtained in a wide temperature range ΔT of at least 60° C. in this case, the soft magnetic property of the core as a whole does not deteriorate even if there occurs a temperature difference in different portions of a core.

In designing a transformer, priority is given to either the magnetic flux density or the core loss depending on the case and, for this reason, it is not necessary that the annealing temperature range to secure a $B_{80}$ of 1.35 T or more, and that to secure a core loss of 0.12 W/kg or less, totally overlap each other. However, when the two temperature ranges are the same, the performance of the Fe-based amorphous alloy thin strip can be reflected to the performance of the transformer to the fullest extent.

The present invention further realizes a thin strip having excellent embrittlement resistance with a bend fracture strain $\epsilon_f$ of 0.01 or more besides the above excellent soft magnetic property. Here, $\epsilon_f=t/(D-t)$, where t is the strip thickness and D is the bend diameter at strip failure.

Here, the evaluation of brittleness is indicated in terms of the distance D between the surfaces of a thin strip when it fractures after it is bent through 180° and gradually pressed to make the distance between two opposite strip portions smaller (the distance D corresponding to the bend diameter at fracture).

The distance between the outer faces of the strip when it fractures is defined as the bend fracture diameter $D_f$. There is a strain of $\epsilon=t/(D-t)$ on the outer side of the bent strip, where t is the strip thickness. The strain at the time of the fracture is, therefore, defined as $\epsilon_f=t/(D_f-t)$.

A conventional Fe-Si-B amorphous alloy thin strip is inevitably embrittled when annealed to create the soft magnetic property. However, it becomes clear that, by further limiting the composition range of the alloy according to the present invention, the embrittlement of the thin strip, after the annealing to create an excellent soft magnetic property, could be suppressed to a considerable extent.

The use of the above Fe-based amorphous alloy thin strip according to the present invention as the material of transformer cores enables high magnetic flux density design of transformers and, consequently, their downsizing and a performance enhancement can be achieved.

The use of the above Fe-based amorphous alloy thin strip according to the present invention as the material of transformer cores also prevents the core properties from being deteriorated by the temperature unevenness at different portions of the core during annealing.

An Fe-based amorphous alloy thin strip according to the present invention can be produced by a method to melt an alloy of a prescribed composition and rapidly cool the molten alloy by ejecting it through a slot nozzle onto a travelling cooling substrate such as the single roll method, the twin roll method or the like. Apparatuses for the single roll method include a centrifugal rapid cooler using the inner surface of a drum, an apparatus to use an endless belt, modifications of these apparatuses equipped with auxiliary rolls, and a caster in a low pressure atmosphere, a vacuum or an inert gas atmosphere. The present invention does not specify the dimension (thickness, width, etc.) of the thin strip, but a thickness, for instance, of 10 μm or more and 100 μm or less and a width of 20 mm or more are preferable.

Some alloy steel grades produced, for example, by the steelmaking process using iron ore as a raw material can be used as the raw material for the present invention. The compositions of such alloy steel grades include, for example, $Fe_{83.5}Si_3B_{12}C_1P_{0.5}$, $Fe_{84.1}Si_{2.5}B_{11.4}C_1P_1$, $Fe_{86.5}Si_{2.2}B_{6.8}C_{0.5}P_4$, $Fe_{87}Si_{2.1}B_{5.6}C_{0.3}P_5$, $Fe_{87.3}Si_{2.1}B_{5.5}C_{0.3}P_{4.8}$, and the like.

The composition of the Fe-based amorphous alloy thin strip includes, for example, $Fe_{80.5}Si_3B_{15}C_1P_{0.5}$, $Fe_{79}Si_3B_{16}C_1P_1$, $Fe_{80.2}Si_{2.3}B_{13}C_{0.5}P_4$, $Fe_{79.4}Si_{3.8}B_{10}C_{0.8}P_6$, $Fe_{81.5}Si_{2.2}B_{6.3}C_1P_9$ and the like, but the alloy composition of the present invention is not limited to these examples.

EXAMPLE 1

The alloys of the compositions expressed, in atomic %, as $Fe_aSi_bB_cC_dP_e$ (where, a+b+c+d+e=99.8) containing 0.2 atomic % of impurities such as Mn, S, etc. were used here. The alloys of the compositions shown in Table 1 were cast by the single roll method and the cast strips were examined to determine if the materials were amorphous.

First, the alloys of the respective compositions were melted in quartz crucibles by high frequency induction heating and then ejected through a rectangular slot nozzle with an opening of 0.4×25 mm set at the top end of the crucible onto a cooling roll of a Cu alloy 580 mm in diameter and rotating at 800 rpm to produce strips about 25 μm in thickness and about 25 mm in width. Then, diffraction profiles of the cast strips on the free surface (the surface not in contact with the roll at the casting) and the roll-side surface (the surface in contact with the roll at the casting) were measured by the X-ray diffraction method. The measurement results are shown in Table 1, where an alloy exhibiting a broadened diffraction profile showing that the material is amorphous is marked with ○, that exhibiting a pointed crystallization peak with x and that exhibiting an intermediate quality with Δ.

TABLE 1

| Sample No. | a (Fe) | b (Si) | c (B) | d (C) | e (P) | Amorphous state forming |
|---|---|---|---|---|---|---|
| 1 (Comparative sample) | 80.9 | 2.2 | 10.5 | 0.7 | 5.5 | ○ |
| 2 (Invention sample) | 82.4 | 2.3 | 8.8 | 0.5 | 5.8 | ○ |
| 3 (Invention sample) | 83.6 | 2.3 | 8.1 | 0.6 | 5.2 | ○ |
| 4 (Invention sample) | 84.5 | 2.1 | 7.7 | 0.4 | 5.1 | ○ |
| 5 (Invention sample) | 86.7 | 2.2 | 5.8 | 0.5 | 4.6 | ○ |
| 6 (Invention sample) | 87.1 | 2.1 | 6.0 | 0.5 | 4.1 | ○ |
| 7 (Invention sample) | 88.4 | 2.2 | 5.1 | 0.3 | 3.8 | ○, (Δ) |
| 8 (Invention sample) | 89.1 | 2.1 | 5.1 | 0.3 | 3.4 | ○, (Δ) |
| 9 (Comparative sample) | 91.1 | 2.1 | 3.3 | 0.3 | 3.0 | X |
| 10 (Comparative sample) | 84.5 | 2.3 | 12.3 | 0.7 | 0 | X |
| 11 (Comparative sample) | 86.7 | 2.4 | 9.9 | 0.8 | 0 | X |
| 12 (Comparative sample) | 88.4 | 2.3 | 8.3 | 0.8 | 0 | Difficult to form thin strip |
| 13 (Invention sample) | 86.7 | 2.3 | 8.9 | 0.8 | 1.1 | ○ |
| 14 (Invention sample) | 86.5 | 2.2 | 7.2 | 0.7 | 3.2 | ○ |

TABLE 1-continued

| Sample No. | a (Fe) | b (Si) | c (B) | d (C) | e (P) | Amorphous state forming |
|---|---|---|---|---|---|---|
| 15 (Comparative sample) | 86.6 | 2.1 | 3.5 | 0.9 | 6.7 | X |
| 16 (Comparative sample) | 86.4 | 2.4 | 2 | 0.8 | 8.2 | X |
| 17 (Comparative sample) | 86.7 | 2.3 | 0.2 | 0.7 | 9.9 | X |
| 18 (Comparative sample) | 86.5 | 1.5 | 6.1 | 0.6 | 5.1 | ○, Δ |
| 19 (Invention sample) | 86.4 | 2.4 | 6.2 | 0.6 | 4.2 | ○ |
| 20 (Invention sample) | 86.5 | 3.5 | 5.6 | 0.4 | 3.8 | ○ |
| 21 (Comparative sample) | 84.1 | 4.5 | 5.3 | 0.6 | 5.3 | ○ |

As seen in Table 1, although samples 1 to 8 were amorphous, samples 7and 8 had portions, if small, where a crystal phase was thought to be included. Sample 9 containing more than 90 atomic % of Fe was difficult to turn into an amorphous state. Note that the magnetic flux density of sample 1 did not fall within the range of the present invention as shown in Example 2. Samples 10 to 12 not containing P were difficult to turn into an amorphous state, and sample 12 could not be formed into a continuous strip.

Among samples 13 to 17 having different contents of B and P in a high Fe content range, samples 13 and 14 containing B and P in the content ranges according to the present invention became amorphous and samples 15 to 17 having B contents of 5 atomic % or less did not.

Among samples 18 to 21 having different contents of Si, while the amorphous state formation became partially unstable in sample 18 where the amount of Si was below 2 atomic %, samples 19 to 21 became amorphous. Note that the core loss of sample 21 did not fall within the range of the present invention as described in Example 2.

As can be understood from the above examples, the use of the alloy composition range according to the present invention enables the amorphous state formation in a high Fe content range where it has conventionally been impossible to form an amorphous state.

EXAMPLE 2

The thin strips of Example 1 which successfully became amorphous were cut to a length of 120 mm, annealed for 1 hr. in a nitrogen atmosphere and under a magnetic field at temperatures set at intervals of 20° C. in a range from 260 to 400° C., and then their magnetic property in alternating current was evaluated using a single sheet tester (SST). The magnetic property was evaluated in terms of the maximum magnetic flux density $B_{80}$ under a maximum magnetic field of 80 A/m applied during measurement and the core loss at a maximum magnetic flux density of 1.3 T. The frequency used for the tests was 50 Hz. In addition, the saturated magnetic flux density $B_9$ was measured by VSM.

Table 2 shows the evaluation results. The table shows the best soft magnetic property figures among those obtained through the annealing at different temperatures from 260 to 400° C. Note that the evaluations of samples 7, 8 and 18, which had portions not completely turned into an amorphous state, relate only to completely amorphous portions.

TABLE 2

| Sample No. | a (Fe) | b (Si) | c (B) | d (C) | e (P) | $B_6$ (T) | $B_{80}$ (T) | Core loss (W/kg) |
|---|---|---|---|---|---|---|---|---|
| 1 (Comparative sample) | 80.9 | 2.2 | 10.5 | 0.7 | 5.5 | 1.60 | 1.49 | 0.082 |
| 2 (Invention sample) | 82.4 | 2.3 | 8.8 | 0.5 | 5.8 | 1.74 | 1.51 | 0.091 |
| 3 (Invention sample) | 83.6 | 2.3 | 8.1 | 0.6 | 5.2 | 1.75 | 1.52 | 0.098 |
| 4 (Invention sample) | 84.5 | 2.1 | 7.7 | 0.4 | 5.1 | 1.75 | 1.53 | 0.105 |
| 5 (Invention sample) | 86.7 | 2.2 | 5.8 | 0.5 | 4.6 | 1.76 | 1.53 | 0.104 |
| 6 (Invention sample) | 87.1 | 2.1 | 6.0 | 0.5 | 4.1 | 1.77 | 1.53 | 0.109 |
| 7 (Invention sample) | 88.4 | 2.2 | 5.1 | 0.3 | 3.8 | 1.75 | 1.52 | 0.112 |
| 8 (Invention sample) | 89.1 | 2.1 | 5.1 | 0.3 | 3.4 | 1.76 | 1.51 | 0.118 |
| 13 (Invention sample) | 86.7 | 2.3 | 8.9 | 0.8 | 1.1 | 1.77 | 1.52 | 0.093 |
| 14 (Invention sample) | 86.5 | 2.2 | 7.2 | 0.7 | 3.2 | 1.76 | 1.51 | 0.101 |
| 18 (Comparative sample) | 86.5 | 1.5 | 6.1 | 0.6 | 5.1 | 1.65 | 1.48 | 0.119 |
| 19 (Invention sample) | 86.4 | 2.4 | 6.2 | 0.6 | 4.2 | 1.76 | 1.52 | 0.092 |
| 20 (Invention sample) | 86.5 | 3.5 | 5.6 | 0.4 | 3.8 | 1.75 | 1.51 | 0.094 |
| 21 (Comparative sample) | 84.1 | 4.5 | 5.3 | 0.6 | 5.3 | 1.74 | 1.51 | 0.135 |

As can be seen in the evaluation results in Table 2, in samples 2 to 14 containing Fe in the range over 82 10 atomic % and up to 90 atomic %, $B_s$ was 1.74 T or more and $B_{80}$ was 1.5 T or more. It can also be seen that good core loss values of 0.12 W/kg or less were obtained. Sample 1 having an Fe content of 82 atomic % or less could not achieve a high $B_s$.

Looking at samples 18 to 21 having different Si contents, the magnetic flux density does not reach the range of the present invention in sample 18 having an Si amount below 2 atomic %, and the core loss does not lower to the range of the present invention in sample 21 having an Si amount of 4 atomic % or more.

As can be understood from the above examples, the use of the alloy composition range according to the present invention enables the amorphous state formation in a high Fe content range where it has conventionally been impossible to form an amorphous state, and realizes an excellent soft magnetic property.

EXAMPLE 3

The alloys of the compositions expressed, in atomic %, as $Fe_{80.3}Si_{2.5}B_{16-X}P_XC_1$ (where: X=0.5, 1.1, 3.2, 6.4, or 9.5) containing 0.2 atomic % of impurities such as Mn, S, etc. were used here. Other alloys were prepared as comparative samples by changing the values of X to 0, 0.05, 13.5, and 16.

First, the alloys of prescribed compositions were melted in quartz crucibles by high frequency induction heating and then ejected through a rectangular slot nozzle with an opening of 0.4×25 mm set at the top end of the crucible onto a cooling roll of a Cu alloy 580 mm in diameter and rotating at 800 rpm to produce strips about 27 $\mu$m in thickness and about 25 mm in width.

The cast strips were cut to a length of 120 mm, annealed for 1 hr. in a nitrogen atmosphere under a magnetic field and at 320, 340, 360, 380 and 400° C., and then their magnetic property in alternating current was a evaluated using a single sheet tester (SST).

The magnetic property was evaluated in terms of the maximum magnetic flux density $B_{80}$ under a maximum magnetic field of 80 A/m applied during measurement and the core loss at a maximum magnetic flux density of 1.3 T. The frequency used for the tests was 50 Hz. Tables 3 and 4 show the evaluation results.

TABLE 3

| | | | Measurement results of $B_{80}$ (unit: T) | | | | | |
|---|---|---|---|---|---|---|---|---|
| | P substitution | B amount | Annealing temperature | | | | | Standard |
| Sample No. | amount (X) | (16 - X) | 320° C. | 340° C. | 360° C. | 380° C. | 400° C. | deviation |
| 22 (Comparative sample) | 0 | 16 | 1.33 | 1.48 | 1.57 | 1.57 | 1.34 | 0.106 |
| 23 (Comparative sample) | 0.05 | 15.95 | 1.19 | 1.43 | 1.55 | 1.55 | 1.53 | 0.137 |
| 24 (Invention sample) | 0.5 | 15.5 | 1.35 | 1.44 | 1.54 | 1.54 | 1.52 | 0.074 |
| 25 (Invention sample) | 1.1 | 14.9 | 1.36 | 1.47 | 1.53 | 1.53 | 1.49 | 0.062 |
| 26 (Invention sample) | 3.2 | 12.8 | 1.41 | 1.50 | 1.52 | 1.52 | 1.51 | 0.042 |
| 27 (Invention sample) | 6.4 | 9.6 | 1.41 | 1.46 | 1.49 | 1.48 | 1.49 | 0.030 |
| 28 (Invention sample) | 9.5 | 8.5 | 1.39 | 1.43 | 1.44 | 1.44 | 1.42 | 0.019 |
| 29 (Invention sample) | 10.8 | 5.2 | 1.35 | 1.41 | 1.43 | 1.44 | 1.42 | 0.032 |

TABLE 3-continued

| Measurement results of $B_{80}$ (unit: T) | | | | | | | | |
|---|---|---|---|---|---|---|---|---|
| | P substitution | B amount | Annealing temperature | | | | | Standard |
| Sample No. | amount (X) | (16 - X) | 320° C. | 340° C. | 360° C. | 380° C. | 400° C. | deviation |
| 30 (Comparative sample) | 13.5 | 2.5 | 1.32 | 1.36 | 1.37 | 1.34 | 1.28 | 0.032 |
| 31 (Comparative sample) | 16 | 0 | 1.30 | 1.32 | 1.32 | 1.23 | 0.13 | 0.467 |

TABLE 4

| Measurement results of core loss (unit: W/kg) | | | | | | | |
|---|---|---|---|---|---|---|---|
| | P substitution | B amount | Annealing temperature | | | | |
| Sample No. | amount (X) | (16 - X) | 320° C. | 340° C. | 360° C. | 380° C. | 400° C. |
| 22 (Comparative sample) | 0 | 16 | 0.148 | 0.136 | 0.132 | 0.162 | 0.276 |
| 23 (Comparative sample) | 0.05 | 15.95 | 0.146 | 0.116 | 0.077 | 0.086 | 0.199 |
| 24 (Invention sample) | 0.5 | 15.5 | 0.120 | 0.108 | 0.076 | 0.108 | 0.194 |
| 25 (Invention sample) | 1.1 | 14.9 | 0.119 | 0.091 | 0.070 | 0.106 | 0.188 |
| 26 (Invention sample) | 3.2 | 12.8 | 0.110 | 0.085 | 0.065 | 0.068 | 0.143 |
| 27 (Invention sample) | 6.4 | 9.6 | 0.103 | 0.076 | 0.063 | 0.061 | 0.082 |
| 28 (Invention sample) | 9.5 | 6.5 | 0.097 | 0.071 | 0.063 | 0.062 | 0.068 |
| 29 (Invention sample) | 10.8 | 5.2 | 0.103 | 0.082 | 0.079 | 0.078 | 0.081 |
| 30 (Comparative sample) | 13.5 | 2.5 | 0.105 | 0.090 | 0.085 | 0.083 | 0.121 |
| 31 (Comparative sample) | 16 | 0 | 0.110 | 0.096 | 0.080 | 0.203 | Measurement impossible |

$B_{80}$ of sample 23, after an additional annealing at 420° C., was 1.29 T. AS is clear from this result and Table 3, samples 24 to 29 (invention samples) where the P contents were 0.2 atomic % or more and 12 atomic % or less exhibited a high magnetic flux density $B_{80}$ of 1.35 T or more in an annealing temperature range from Tmin=320° C. to Tmax=400° C., namely in a wide annealing temperature range of ΔT=80° C., and a standard deviation of $B_{80}$ below 0.1 in the above annealing temperature range, which fact demonstrates that it is possible to reduce the unevenness of the magnetic flux density.

In the P content range of 1 atomic % or more and 12 atomic % or less of samples 25 to 29, the standard deviation of $B_{80}$ was 0.07 or less, which fact shows that thin strips having a smaller unevenness of the magnetic flux density were obtained. Further, in the B content range over 5 atomic % and below 14 atomic % of samples 26 to 29, the standard deviation of $B_{80}$ was 0.05 or less, which shows that thin strips having a still smaller unevenness of the magnetic flux density were obtained.

Table 4 shows that samples 24 to 29 (invention samples), having the compositions according to the present invention demonstrate low core loss values of 0.12 W/kg. or less in an annealing temperature range from Tmin=320° C. to Tmax=380° C., namely in a wide annealing temperature range of ΔT=60° C. Although sample 30 had core loss values not exceeding 0.12 W/kg in a wide annealing temperature range of 60° C., it was classified as a comparative sample, because its $B_{80}$ values were within the level of comparative samples. Sample 31 annealed at 400° C. could not be excited to a magnetic flux density of 1.3 T.

EXAMPLE 4

The alloys of the compositions expressed, in atomic %, as $Fe_{80.3}Si_YB_{15.2-Y}P_{3.3}C_1$ (where: Y=1.7, 2.2, 2.9, 3.4, 3.8, 4.3, or 5.5) containing 0.2 atomic % of impurities such as Mn, S, etc. were used here. The alloys were cast into thin strips by the method of Example 3 and their magnetic property was evaluated in the same manner as Example 3. Tables 5 and 6 show the evaluation results.

TABLE 5

| Measurement results of $B_{80}$ (unit: T) | | | | | | | | |
|---|---|---|---|---|---|---|---|---|
| | Si amount | B amount | Annealing temperature | | | | | Standard |
| Sample No. | (Y) | (15.2 - Y) | 320° C. | 340° C. | 360° C. | 380° C. | 400° C. | deviation |
| 32 (Comparative sample) | 1.7 | 13.5 | 1.22 | 1.43 | 1.50 | 1.48 | 1.46 | 0.102 |
| 33 (Invention sample) | 2.2 | 13.0 | 1.42 | 1.50 | 1.52 | 1.52 | 1.51 | 0.038 |
| 34 (Invention sample) | 2.9 | 12.3 | 1.41 | 1.51 | 1.51 | 1.51 | 1.52 | 0.041 |
| 35 (Invention sample) | 3.4 | 11.8 | 1.40 | 1.51 | 1.50 | 1.52 | 1.51 | 0.044 |
| 36 (Invention sample) | 3.8 | 11.4 | 1.39 | 1.49 | 1.50 | 1.51 | 1.50 | 0.044 |
| 37 (Comparative sample) | 4.3 | 10.9 | 1.29 | 1.43 | 1.46 | 1.49 | 1.47 | 0.072 |
| 38 (Comparative sample) | 5.5 | 9.7 | 1.21 | 1.47 | 1.49 | 1.50 | 1.47 | 0.110 |

TABLE 6

| Measurement results of core loss (unit: W/kg) | | | | | | | |
|---|---|---|---|---|---|---|---|
| | Si amount | B amount | Annealing temperature | | | | |
| Sample No. | (Y) | (15.2 - Y) | 320° C. | 340° C. | 360° C. | 380° C. | 400° C. |
| 32 (Comparative sample) | 1.7 | 13.5 | 0.112 | 0.109 | 0.103 | 0.108 | 0.142 |
| 33 (Invention sample) | 2.2 | 13.0 | 0.109 | 0.086 | 0.067 | 0.068 | 0.138 |
| 34 (Invention sample) | 2.9 | 12.3 | 0.109 | 0.087 | 0.075 | 0.078 | 0.134 |
| 35 (Invention sample) | 3.4 | 11.8 | 0.110 | 0.089 | 0.080 | 0.082 | 0.132 |
| 36 (Invention sample) | 3.8 | 11.4 | 0.110 | 0.088 | 0.084 | 0.087 | 0.132 |
| 37 (Comparative sample) | 4.3 | 10.9 | 0.128 | 0.092 | 0.085 | 0.090 | 0.175 |
| 38 (Comparative sample) | 5.5 | 9.7 | 0.138 | 0.093 | 0.073 | 0.085 | 0.185 |

$B_{80}$ values of samples 32, 37 and 38 after an additional annealing at 420° C. were 1.34, 1.31 and 1.27 T, respectively. As is clear from these results and Table 5,. samples 33 to 36 (invention samples) where the Si contents were 2 atomic % or more and below 4 atomic % exhibited high values of magnetic flux density $B_{80}$ of 1.35 T or more in an annealing temperature range from Tmin=320° C. to Tmax=400° C., namely in a wide annealing temperature range of ΔT=80° C., and a standard deviation of $B_{80}$ below 0.1 in the above annealing temperature range, demonstrating that it is possible to reduce the unevenness of the magnetic flux density.

Although sample 37 (comparative sample) had a standard deviation of $B_{80}$ below 0.1, it did not show $B_{80}$ values of 1.35 T or more in an annealing temperature range ΔT of at least 80° C.

Also, in Table 6, it can be seen that samples 33 to 36 (invention samples) demonstrate low core loss values of 0.12 W/kg or less in an annealing temperature range from Tmin=320° C. to Tmax=380° C., namely in a wide annealing temperature range of ΔT=60° C. Although sample 32 had core loss values below 0.12 W/kg in an annealing temperature range of ΔT=60° C., it was classified as a comparative sample, since its $B_{80}$ values were within the level of comparative samples. From the above it is understood that, when the Si content is 4 atomic % or more, the effects of the P addition of the present invention fail to appear.

EXAMPLE 5

Thin strips were cast by the same method as Example 3 from alloys containing different amounts of Fe, B and C, while maintaining the contents of P and Si at 3.4 and 2.5 atomic %, respectively. The alloys contained 0.2 atomic % of impurities such as Mn, S, etc.

The magnetic property of the thin strips was evaluated in the same manner as Example 3 except that the annealing temperature ranged from 280 to 400° C. Tables 7 and 8 show the evaluation results.

TABLE 7

| Measurement results of $B_{80}$ (unit: T) | | | | | | | | | | | |
|---|---|---|---|---|---|---|---|---|---|---|---|
| | | | | Annealing temperature | | | | | | | Standard |
| Sample No. | Fe | B | C | 280° C. | 300° C. | 320° C. | 340° C. | 360° C. | 380° C. | 400° C. | deviation |
| 39 (Comparative sample) | 87 | 6.7 | 0.2 | 0.76 | 0.87 | 0.97 | 0.98 | 0.98 | 0.19 | 0.12 | 0.087 |
| 40 (Invention sample) | 85 | 8.7 | 0.2 | 1.37 | 1.40 | 1.47 | 1.50 | 1.51 | 0.26 | 0.13 | 0.055 |
| 41 (Invention sample) | 83.5 | 10 | 0.4 | 1.38 | 1.39 | 1.46 | 1.49 | 1.47 | 0.30 | 0.13 | 0.044 |
| 42 (Invention sample) | 81.2 | 12 | 0.7 | 1.37 | 1.40 | 1.43 | 1.49 | 1.50 | 1.48 | 1.36 | 0.038 |

TABLE 7-continued

| Measurement results of $B_{80}$ (unit: T) | | | | | | | | | | | |
|---|---|---|---|---|---|---|---|---|---|---|---|
| | | | | Annealing temperature | | | | | | | Standard |
| Sample No. | Fe | B | C | 280° C. | 300° C. | 320° C. | 340° C. | 360° C. | 380° C. | 400° C. | deviation |
| 43 (Invention sample) | 80.2 | 12.7 | 1.0 | 1.36 | 1.39 | 1.42 | 1.50 | 1.51 | 1.52 | 1.50 | 0.038 |
| 44 (Invention sample) | 79.5 | 12.9 | 1.5 | 1.34 | 1.38 | 1.41 | 1.47 | 1.48 | 1.47 | 1.46 | 0.025 |
| 45 (Invention sample) | 78.2 | 13.7 | 2.0 | 1.28 | 1.35 | 1.36 | 1.38 | 1.42 | 1.44 | 1.43 | 0.031 |
| 46 (Comparative sample) | 77.2 | 15.0 | 1.7 | 1.12 | 1.16 | 1.31 | 1.33 | 1.37 | 1.39 | 1.38 | 0.031 |
| 47 (Comparative sample) | 76.1 | 17.5 | 0.3 | 1.01 | 1.11 | 1.26 | 1.27 | 1.26 | 1.25 | 1.24 | 0.010 |

TABLE 8

| Measurement results of core loss (unit: W/kg) | | | | | | | | | | |
|---|---|---|---|---|---|---|---|---|---|---|
| | | | | Annealing temperature | | | | | | |
| Sample No. | Fe | B | C | 280° C. | 300° C. | 320° C. | 340° C. | 360° C. | 380° C. | 400° C. |
| 39 (Comparative sample) | 87 | 6.7 | 0.2 | 0.456 | 0.476 | 0.521 | 0.786 | 1.289 | 5.041 | 7.048 |
| 40 (Invention sample) | 85 | 8.7 | 0.2 | 0.120 | 0.115 | 0.113 | 0.118 | 0.346 | 4.025 | 6.048 |
| 41 (Invention sample) | 83.5 | 10 | 0.4 | 0.118 | 0.110 | 0.090 | 0.077 | 0.240 | 3.013 | 5.201 |
| 42 (Invention sample) | 81.2 | 12 | 0.7 | 0.123 | 0.112 | 0.101 | 0.081 | 0.111 | 0.119 | 0.198 |
| 43 (Invention sample) | 80.2 | 12.7 | 1.0 | 0.132 | 0.115 | 0.109 | 0.084 | 0.067 | 0.069 | 0.145 |
| 44 (Invention sample) | 79.5 | 12.9 | 1.5 | 0.135 | 0.114 | 0.099 | 0.082 | 0.068 | 0.070 | 0.137 |
| 45 (Invention sample) | 78.2 | 13.7 | 2.0 | 0.132 | 0.115 | 0.100 | 0.081 | 0.072 | 0.071 | 0.128 |
| 46 (Comparative sample) | 77.2 | 15.0 | 1.7 | 0.138 | 0.111 | 0.098 | 0.086 | 0.077 | 0.081 | 0.125 |
| 47 (Comparative sample) | 76.1 | 17.5 | 0.3 | 0.133 | 0.110 | 0.113 | 0.099 | 0.100 | 0.102 | 0.127 |

The standard deviation of $B_{80}$ was calculated from the values obtained in an annealing temperature band of 80° C. (the area of Table 7 surrounded by bold lines) where the values of the standard deviation were the lowest.

$B_{80}$ of sample 46 was 1.33 T after an additional annealing at 420° C. As is clear from this result and Table 7, samples 40 to 45 (invention samples) where the Fe contents were 78 atomic % or more and 86 atomic % or less exhibited high values of magnetic flux density $B_{80}$ of 1.35 T or more in a wide annealing temperature range ΔT of at least 80° C., and the standard deviations of $B_{80}$ below 0.1 in the above annealing temperature range, demonstrating a reduced unevenness of the magnetic flux density.

Sample 39 (comparative sample) having an Fe content exceeding 86 atomic %, although the standard deviation of its magnetic flux density was below 0.1, could not be formed into anamorphous state and its $B_{80}$ values were as low as 1 T or less. In comparative samples 46 and 47, although their standard deviations of the magnetic flux density were below 0.1 as the above case, their values of $B_{80}$ could not reach 1.35 T or more in a wide annealing temperature range ΔT of at least 80° C. or more.

In samples 42 and 43 (invention samples), in which the Fe contents were over 80 atomic % and 82 atomic % or less, their standard deviations of $B_{80}$ were small and the values of $B_{80}$ were 1.35 T or more in a wider annealing temperature range from Tmin=280° C. to Tmax=400° C., which fact shows that excellent thin strips were obtained.

From the results shown in Table 8, it is seen that, in samples 40 to 45 (invention samples), 46 and 47 (comparative samples), core loss values of 0.12 W/kg or less have been achieved in a wide annealing temperature range ΔT of at least 60° C. or more, though those were not achievable by conventional technologies. Note that samples 46 and 47 were classified as comparative samples, since a $B_{80}$ of 1.35 T or more was not achieved in a wide annealing temperature range ΔT of at least 80° C. Because sample 39 (comparative sample) did not form an amorphous state, its core loss was large.

EXAMPLE 6

Amorphous thin strips, 50 mm in width, were cast from the alloy of sample 27. The casting method was the same as that of Example 3 except that the opening shape of the rectangular slot nozzle was changed to 0.4×50 mm. The thickness of the cast thin strips was 26 μm.

The strips were wound into toroidal cores about 50 mm in winding thickness, and the cores were heated from room temperature to 400° C. at different heating rates, held at 400° C. for 2 hr., and then cooled in a furnace. A magnetic field was imposed on the cores in their circumferential direction during the heating. The heating temperature was controlled in terms of the furnace atmosphere temperature, and the actual temperature of the cores was measured with thermocouples placed at different portions of the cores.

The measurements showed the tendency that, the higher the heating rate, the larger the temperature difference between the furnace atmosphere and the cores and the larger the temperature difference among different portions of a core. The temperature of the cores did not exceed the furnace atmosphere temperature.

The values of $B_{80}$ of the cores were measured by winding primary and secondary coils on them after the annealing.

As a result, it was confirmed that the values of $B_{80}$ were kept as high as 1.43 T or more even when the temperature difference among different portions of a core was as large as 80 to 100° C.

The same test was conducted using the alloy of sample 37 for comparison purposes. It was made clear in this case that the values of $B_{80}$ fell as low as 1.32 T or less when the temperature difference among different portions of a core was as large as 80 to 100° C.

EXAMPLE 7

The alloys of the compositions expressed, in atomic %, as $Fe_{80.3}Si_{2.7}B_{16-X}P_XC_{0.8}$ (where: X=1.3, 3.5, 6.2, or 9.4) containing 0.2 atomic % of impurities such as Mn, S, etc. were used here. Other alloys were prepared as comparative samples by changing the values of X to 0 and 14.5.

First, the alloys of prescribed compositions were melted in quartz crucibles by high frequency induction heating and then ejected through a rectangular slot nozzle with an opening of 0.4×25 mm set at the top end of the crucible onto a cooling roll of a Cu alloy 580 mm in diameter and rotating at 800 rpm to produce strips about 26 μm in thickness and about 25 mm in width.

The cast strips were cut to a length of 120 mm, annealed for 1 hr. in a nitrogen atmosphere under a magnetic field and at 320, 340, 360, 380 and 400° C., and then their magnetic property in alternating current was evaluated using a single sheet tester (SST).

The magnetic property was evaluated in terms of the maximum magnetic flux density $B_{80}$ under a maximum magnetic field of 80 A/m imposed during measurement and the core loss of $W_{13/50}$ at a maximum magnetic flux density of 1.3 T. The frequency used for the tests was 50 Hz.

The bend fracture strain $\epsilon_f$ of the thin strips annealed at each of the above temperatures was also measured. The strips were bent with their R surface (the surface in contact with the roll at casting) facing outside. Table 9 shows the results. Table 9

TABLE 9

Measurement results of $B_{80}$(T), $W_{13/50}$ (W/kg) and $\epsilon_f$

| Sample No. | P Substitution amount (X) | Measurement item | Annealing temperature 320° C. | 340° C. | 360° C. | 380° C. | 400° C. |
|---|---|---|---|---|---|---|---|
| 48 (Comparative sample) | 0 | $B_{80}$ | 1.32 | 1.47 | 1.57 | 1.56 | 1.35 |
| | | $W_{13/50}$ | 0.146 | 0.134 | 0.133 | 0.163 | 0.282 |
| | | $\epsilon_f$ | 0.025 | 0.022 | 0.016 | 0.009 | 0.008 |
| 49 (Invention sample) | 1.3 | $B_{80}$ | 1.37 | 1.48 | 1.54 | 1.53 | 1.48 |
| | | $W_{13/50}$ | 0.116 | 0.092 | 0.072 | 0.108 | 0.189 |
| | | $\epsilon_f$ | 0.020 | 0.016 | 0.012 | 0.008 | 0.008 |
| 50 (Invention sample) | 3.5 | $B_{80}$ | 1.40 | 1.51 | 1.52 | 1.53 | 1.52 |
| | | $W_{13/50}$ | 0.109 | 0.087 | 0.068 | 0.069 | 0.145 |
| | | $\epsilon_f$ | 0.019 | 0.016 | 0.011 | 0.007 | 0.007 |
| 51 (Invention sample) | 6.2 | $B_{80}$ | 1.42 | 1.45 | 1.48 | 1.49 | 1.48 |
| | | $W_{13/50}$ | 0.105 | 0.079 | 0.067 | 0.065 | 0.086 |
| | | $\epsilon_f$ | 0.016 | 0.015 | 0.011 | 0.007 | 0.006 |
| 52 (Invention sample) | 9.4 | $B_{80}$ | 1.38 | 1.44 | 1.45 | 1.44 | 1.41 |
| | | $W_{13/50}$ | 0.095 | 0.070 | 0.064 | 0.063 | 0.070 |
| | | $\epsilon_f$ | 0.014 | 0.013 | 0.009 | 0.007 | 0.007 |
| 53 (Comparative sample) | 14.5 | $B_{80}$ | 1.33 | 1.35 | 1.36 | 1.34 | 1.29 |
| | | $W_{13/50}$ | 0.108 | 0.095 | 0.086 | 0.084 | 0.128 |
| | | $\epsilon_f$ | 0.012 | 0.009 | 0.007 | 0.005 | 0.005 |

The areas in Table 9 surrounded by bold lines are the areas where both an excellent embrittlement resistance with a bend fracture strain $\epsilon_f$ of 0.01 or more and an excellent soft magnetic property with $B_{80}$ of 1.35 T or more and $W_{13/50}$ of 0.12 W/kg or less are realized.

Whereas the annealing temperature to raise $\epsilon_f$ to 0.01≦or more was 360° C. or below in samples 48 to 51, $B_{80}$ of sample 48 (comparative sample) fell to 1.35 T or below after an annealing at 320° C.

Further, $W_{13/50}$ of sample 48 (comparative sample) could not be lowered to 0.12 W/kg or below at whatever annealing temperature range. In contrast, samples 49 to 51 (invention samples) maintained an excellent soft magnetic property with the values of $B_{80}$ of 1.35 T or more and the values of $W_{13/50}$ of 0.12 W/kg or less even after their brittleness was improved through a low temperature annealing at 360° C. or below to increase $\epsilon_f$. Sample 52 (invention sample) demonstrated excellent embrittlement resistance and soft magnetic property after an annealing at 340° C. or below. Sample 53 (comparative sample) exhibited the values of $\epsilon_f$ of 0.01≦or more after an annealing at 320° C. or below, but its values of $B_{80}$ fell to 1.35 T or below.

What is claimed is:

1. An Fe-based amorphous alloy thin strip consisting of the main component elements of Fe, Si, B, C and P and unavoidable impurities, characterized in that its composition is, in atomic %, $78 \leqq Fe \leqq 90$, $2 \leqq Si < 4$, $5 < B \leqq 16$, $0.02 \leqq C \leqq 4$, and $0.2 \leqq P \leqq 12$.

2. An Fe-based amorphous alloy thin strip according to claim 1 excellent in soft magnetic property for use in alternating current applications, characterized in that its composition is, in atomic %, $78 \leqq Fe \leqq 86$, $2 \leqq Si < 4$, $5 < B \leqq 16$, $0.02 \leqq C \leqq 4$, and $0.2 \leqq P \leqq 12$.

3. An Fe-based amorphous alloy thin strip excellent in soft magnetic property for use in alternating current applications according to claim 2, characterized in that the Fe content is $80 < Fe \leqq 82$ atomic %.

4. An Fe-based amorphous alloy thin strip excellent in soft magnetic property for use in alternating current applications according to claim 2, characterized in that the P content is $1 \leqq P \leqq 12$ atomic %.

5. An Fe-based amorphous alloy thin strip excellent in soft magnetic property for use in alternating current applications according to claim 2, characterized in that the B content is $5 \leqq 14$ atomic %.

6. An Fe-based amorphous alloy thin strip excellent in soft magnetic property for use in alternating current applications according to claim 2, characterized by having, after annealing, a soft magnetic property the value of $B_{80}$ of 1.35 T or more and the standard deviation of $B_{80}$ of less than 0.1.

7. An Fe-based amorphous alloy thin strip excellent in soft magnetic property for use in alternating current applications according to claim 6, characterized by further having, after annealing, a core loss property with a core loss value of 0.12 W/kg or less.

8. An Fe-based amorphous alloy thin strip excellent in soft magnetic property for use in alternating current applications according to claim 2, characterized by having an annealing temperature property with $\Delta T$ of at least 80° C., where the highest temperature of the thin strip annealing to secure the soft magnetic property with $B_{80}$ of 1.35 T or more and the standard deviation of $B_{80}$ below 0.1 is Tmax, the lowest temperature of the same annealing is Tmin and $\Delta T = Tmax - Tmin$.

9. An Fe-based amorphous alloy thin strip excellent in soft magnetic property for use in alternating current applications according to claim 8, characterized by having, in addition to the soft magnetic property, an annealing temperature property with $\Delta T$ of at least 60° C., where the highest temperature of the thin strip annealing to secure the core loss property with a core loss value of 0.12 W/kg or less is Tmax, the lowest temperature of the same annealing is Tmin and $\Delta T = Tmax - Tmin$.

10. An Fe-based amorphous alloy thin strip excellent in soft magnetic property for use in alternating current applications according to claim 2, characterized by having, after annealing, both an excellent soft magnetic property with $B_{80}$ of 1.35 T or more and an excellent embrittlement resistance with bend fracture strain $\epsilon_f$ of 0.01 or more (where $\epsilon_f = t/(D_f - t)$, t is the strip thickness and $D_f$ is the bend diameter at strip failure).

11. An Fe-based amorphous alloy thin strip excellent in soft magnetic property for use in alternating current applications according to claim 10, characterized by having, after annealing, a core loss property with a core loss value of 0.12 W/kg or less.

12. An Fe-based amorphous alloy thin strip according to claim 1 having a high magnetic flux density, characterized in that its composition is, in atomic %, $86 < Fe \leqq 90$, $2 \leqq Si < 4$, $5 < B \leqq 16$, $0.02 \leqq C \geqq 4$, and $0.2 \leqq P \leqq 12$.

13. An Fe-based amorphous alloy thin strip having a high magnetic flux density according to claim 12, characterized in that the Fe content is $86 < Fe \leqq 88$ atomic %.

14. An An Fe-based amorphous alloy thin strip having a high magnetic flux density according to claim 12, characterized in that $B_s$ of the strip after annealing is 1.74 T or more.

15. An Fe-based amorphous alloy thin strip having a high magnetic flux density according to claim 12, characterized in that $B_{80}$ of the strip after annealing exceeds 1.5 T.

16. An Fe-based amorphous alloy thin strip having a high magnetic flux density according to claim 15, characterized in that, further, the core loss value of the strip after annealing is 0.12 W/kg or less.

17. An Fe-based amorphous alloy thin strip having a high magnetic flux density according to claim 1, characterized in that; its composition is, in atomic %, $82 \leqq Fe \leqq 90$, $2 \leqq Si < 4$, $5 < B \leqq 16$, $0.02 \leqq C \leqq 4$, and $0.2 \leqq P \leqq 12$, and $B_s$ of the strip after annealing is 1.74 T or more.

18. A wound core excellent in soft magnetic property for use in alternating current applications characterized by being produced by winding toroidally and than annealing the Fe-based amorphous alloy thin strip excellent in soft magnetic property for use in alternating current applications according to claim 1.

19. A laminated core excellent in soft magnetic property for use in alternating current applications characterized by being produced by stamping into the sheets of a prescribed shape, laminating and then annealing the Fe-based amorphous alloy thin strip excellent in soft magnetic property in alternating current applications according to claim 1.

* * * * *